US007972166B2

(12) United States Patent
Hiner et al.

(10) Patent No.: US 7,972,166 B2
(45) Date of Patent: Jul. 5, 2011

(54) WATERPROOF PUSH-IN WIRE CONNECTORS

(75) Inventors: William Hiner, O'Fallon, MO (US); Lloyd Herbert King, Jr., Chesterfield, MO (US)

(73) Assignee: The Patent Store, LLC, O'Fallon, MO (US)

( * ) Notice: Subject to any disclaimer, the term of this patent is extended or adjusted under 35 U.S.C. 154(b) by 0 days.

(21) Appl. No.: 12/224,151

(22) PCT Filed: Jun. 13, 2008

(86) PCT No.: PCT/US2008/007499

§ 371 (c)(1),
(2), (4) Date: Aug. 14, 2008

(87) PCT Pub. No.: WO2009/005588

PCT Pub. Date: Jan. 8, 2009

(65) Prior Publication Data

US 2010/0167581 A1 Jul. 1, 2010

Related U.S. Application Data

(60) Provisional application No. 60/937,729, filed on Jun. 29, 2007.

(51) Int. Cl.
*H01R 4/24* (2006.01)

(52) U.S. Cl. ..... 439/441; 174/76; 439/521; 439/936

(58) Field of Classification Search ..... 439/521, 439/441, 438–439, 587, 936; 174/76
See application file for complete search history.

(56) References Cited

U.S. PATENT DOCUMENTS

| | | | | |
|---|---|---|---|---|
| 4,662,692 | A | 5/1987 | Uken et al. | 339/96 |
| 4,673,233 | A * | 6/1987 | Hertelendy | 439/442 |
| 4,781,602 | A * | 11/1988 | Cobaugh | 439/82 |
| 4,973,263 | A | 11/1990 | Nielsen | 439/438 |
| 5,113,037 | A | 5/1992 | King, Jr. et al. | 174/87 |
| 5,205,757 | A * | 4/1993 | Hertelendy | 439/441 |
| 5,427,270 | A | 6/1995 | Patterson | 220/250 |
| 5,427,547 | A | 6/1995 | Shimirack et al. | 439/521 |
| 5,484,304 | A * | 1/1996 | Capper et al. | 439/409 |
| 5,807,133 | A * | 9/1998 | Arnett | 439/418 |
| 5,911,598 | A * | 6/1999 | Pawlenko | 439/521 |
| 6,007,356 | A | 12/1999 | Stein | 439/284 |
| 6,120,324 | A | 9/2000 | Murayama et al. | 439/587 |
| 6,280,237 | B1 | 8/2001 | Saka et al. | 439/489 |
| 6,364,692 | B1 | 4/2002 | Okayasu et al. | 439/426 |
| 6,383,032 | B1 | 5/2002 | Gerberding | 439/681 |
| 6,435,756 | B1 | 8/2002 | Robin et al. | 403/221 |
| 6,487,606 | B1 | 11/2002 | McNerney et al. | 439/415 |
| 6,514,102 | B1 | 2/2003 | Murakami et al. | 439/587 |
| 6,641,417 | B2 | 11/2003 | Tanaka et al. | 439/205 |

(Continued)

FOREIGN PATENT DOCUMENTS

JP 2003023728 1/2003

*Primary Examiner* — Michael C Zarroli
(74) *Attorney, Agent, or Firm* — Jacobson & Johnson LLC

(57) ABSTRACT

A push-in wire connector having a sealant therein to enable formation of a waterproof electrical connection by axial insertion of a wire into a chamber contained an electrical conductor protected by the sealant with the electrical conductor displaceable into a waterproof electrical contact with the wire while both the conductor and the wire remain in the presence of the sealant.

7 Claims, 3 Drawing Sheets

U.S. PATENT DOCUMENTS

| | | | | |
|---|---|---|---|---|
| 6,676,447 | B1 | 1/2004 | Knox | 439/587 |
| 6,848,949 | B2 * | 2/2005 | Mullaney et al. | 439/676 |
| 7,070,463 | B2 | 7/2006 | Arai et al. | 439/787 |
| 7,083,474 | B1 | 8/2006 | Fleck et al. | 439/668 |
| 7,104,823 | B2 | 9/2006 | Jazowski et al. | 439/181 |
| 7,104,840 | B2 | 9/2006 | Murakami | 439/587 |
| 2006/0270269 | A1 | 11/2006 | Quintanilla | 439/417 |

* cited by examiner

WATERPROOF PUSH-IN WIRE CONNECTORS

CROSS REFERENCE TO RELATED APPLICATIONS

This application claims priority from provisional application 60/937,729 titled Push-in Wire Connector filed Jun. 29, 2007 and PCT application PCT/US2008/007499 titled Push-in Wire Connector filed Jun. 13, 2008.

FIELD OF THE INVENTION

This invention relates generally to push-in wire connectors and, more specifically, to waterproof push-in wire connectors.

STATEMENT REGARDING FEDERALLY SPONSORED RESEARCH OR DEVELOPMENT

None

REFERENCE TO A MICROFICHE APPENDIX

None

BACKGROUND OF THE INVENTION

Numerous types of aggressive electrical wire connectors for forming bared ends of electrical wires into a waterproof electrical connection are known in the art. One type of aggressive electrical connector relies on inserting the wires into a sealant located between a terminal block and a terminal screw and then squeezing the bared ends of the wire by rotating the terminal screw. The more the terminal screw is tightening the greater the squeezing and hence the better the electrical connection between the bared wire end and the terminal screw.

Another type of aggressive electrical wire connector is a twist-on wire connector that can be used to form a waterproof electrical connection through rotation of the electrical wires in a spiral shape housing containing a sealant. In the twist-on wire connector as well as the terminal connector the more aggressive the rotation the greater the compression of the wire ends and hence an enhanced electrical connection between the electrical wires.

Another type of aggressive electrical wire connector, which is used with unstripped wires, is a cutting connector that uses two blades that slice through the insulation layer of the electrical wire and also cut into the sides of the wire, which is located in a waterproof sealant. In each of these prior connectors the electrical connection can be formed in the presence of a waterproof agent through use of a force sufficient to negate the presence of a waterproofing and electrically insulating agent located on and between the electrical wires.

Another type of electrical connector, which lacks aggressiveness, is a push-in wire connector. A push-in wire connector is a less aggressive wire connector since the force on the wire by the connector is generated by a fixed cantilevered mounted electrical conductor that flexes to allow insertion of an electrical wire between the conductor and a bus strip. The clamping force holding the wire in electrical contact with bus strip and the electrical conductor of the push-in wire connector are determined by the resilient force of the electrical conductor and can not be increased by more aggressive action such as in twist-on wire connectors since the axial force applied to flex the resilient conductor in a push-in wire connector is limited by the stiffness of the wire. That is, to generate a clamping force on the electrical wire in a push-in wire connector the wire must be inserted in an axial direction, which is at 90 degrees to the direction of force generated by the resilient conductor. Thus the resilient electrical conductor in a push-in wire connector must flex in response to one axially inserting a wire therein. The wire clamping force in the push-in wire connector is limited because the axial resistance of the resilient conductor must not be so large so as to bend the electrical wire during the insertion process. Consequently, clamping forces generated by push-in wire connectors lack the inherent aggressive nature of other connectors that can force sealant away from contact areas between conductors in order to form a low resistance electrical contact.

Although the push-in wire connectors lack the aggressiveness of other electrical wire connectors the push-in wire connector are simple to use since an electrical connection can be made in one continuous motion. That is, one axially inserts an electrical wire into a chamber in the push-in wire connector until the wire forms electrical engagement with a resilient conductor that automatically flexes to form pressure engagement with the electrical wire. Typically, in the push-in wire connector cylindrical elements of a cylindrical wire engage both a bus strip and a resilient conductor as they sandwich the electrical wire between a straight edge on the resilient wire conductor and the bus strip. However, the lack of an ability to increase the force on the contact regions between the edge, the bus strip and the wire limit the ability to enhance the electrical connection in a push-in wire through use of additional force.

Because of the limited contact area and the inability to increase the forces on the wire ends the push-in type of wire connectors are best used in regions where waterproof wire connections are generally not required.

If a waterproof connection is required in a push-in wire connector the conventional methods of waterproofing are to either place an elastic bushing around the wire before the wire is inserted into the push-in wire connector to form a waterproof seal around the electrical wire or to inject a sealant in the push-in wire connector after the wire has been inserted into engagement with the electrical conductor and bus strip therein. In still another method of waterproofing push-in wire connectors the entire push-in wire connectors with the electrical wires therein is inserted into a housing containing a sealant which allows one to encapsulate the entire push-in wire connector and thereby waterproof the wire connections therein.

SUMMARY OF THE INVENTION

A push-in wire connector containing a wire displaceable sealant therein to enable the formulation of a waterproof electrical connection in a single motion by axial insertion of the wire into a chamber contained a resilient conductor, a bus strip and a wire displaceable sealant which is located in a chamber of the push-in wire connector to form a protective waterproof covering over the contact regions between conductors. In one example a wire displaceable sealant is placed in the chamber in an uncured state yet when cured the wire displaceable sealant can flex sufficiently so as not to impair axial insertion of the electrical wire or the formation of an electrical connection between the wire engaging members of the push-in wire connector. In another example a viscous wire displaceable sealant is inserted into the push-in wire connector.

DESCRIPTION OF THE PREFERRED EMBODIMENT

Figure 1:
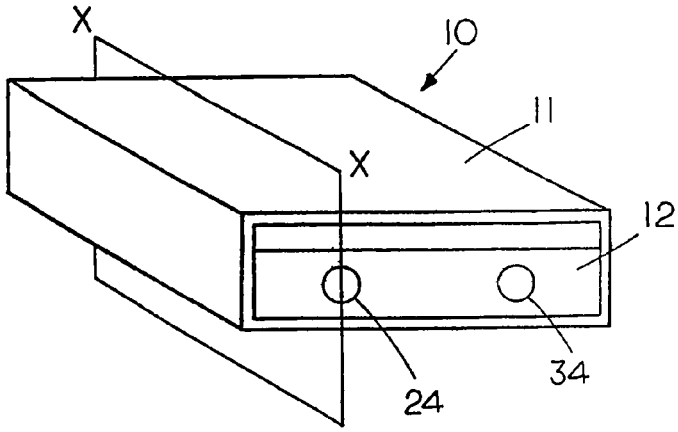
FIG. 1 shows a perspective view of a push-in wire connector.

FIG. 1 shows a perspective view of a push-in wire connector 10 having a casing 11 with a housing 12 containing a wire displaceable sealant therein. Housing 12 includes a first wire socket 24 forming a wire inlet passage and a second wire socket 34 forming a further wire inlet passage. In joining two wires into an electrical connection in the push-in wire connector 10 a first bared wire end is axially inserted into the socket 24 and into engagement with a common bus strip therein to form electrical contact with the bus strip and a second bared wire end, which is to be electrically joined to the first wire, is axially inserted into the wire socket 34 and into engagement with the common bus strip in the push-in connector 10. The push-in wire connector 10 allows one form a waterproof electrical connection in a one step process by axially inserting a wire into electrical contact with an electrical conductor in the presence of a wire displaceable sealant without requiring additional steps such as either rotating the wires or squeezing the wires by forcing jaws or clamps onto the electrical wire. In the examples of the invention shown a wire displaceable sealant located in the chamber waterproofs the resilient conductor in the chamber so that the axial insertion of a wire into the axial passage flexes the resilient conductor in the presence of the sealant to form a waterproof electrical connection in the push-in wire connector.

Figure 1A:
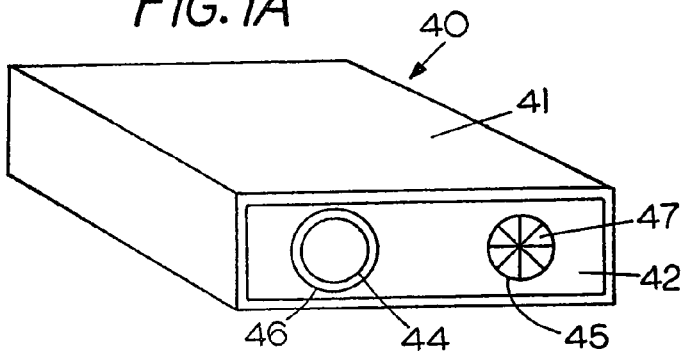
FIG. 1A shows a perspective view of another example of a push-in wire connector.

FIG. 1A shows another example of a push-in wire connector 40 having a casing 41 and a housing 42. A first pierceable one piece cover 46, such as a pierceable film extends over the socket 44 and a second pierceable cover 47 of pie shaped flexible segments extends over a second socket 45. Cover 46 and cover 47 may or may not be used and if used with push-in wire connector 40 may be used to protect the sealant in the push-in wire connector from accidentally contacting other items.

Figure 2:
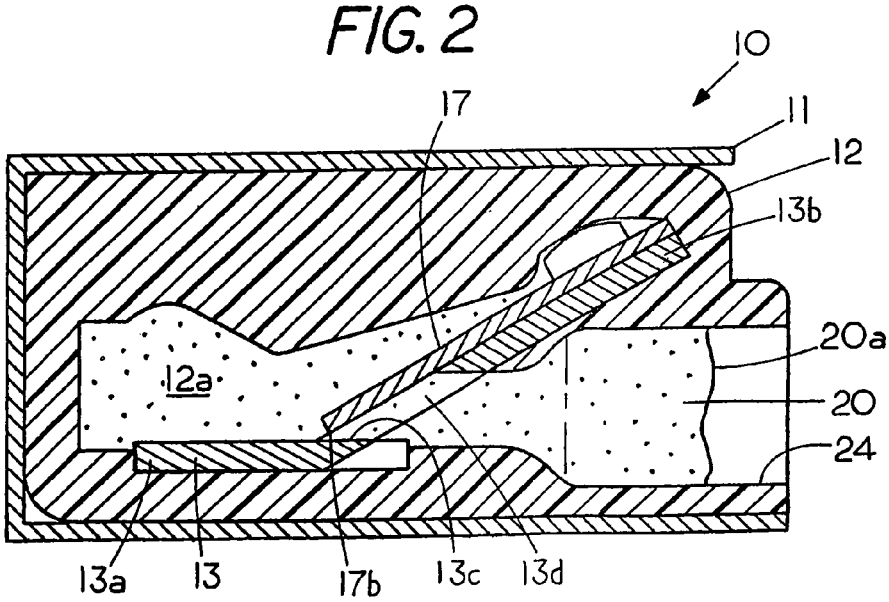
FIG. 2 shows a cross sectional view of a push-in wire connector containing a sealant therein taken along plane x-x of FIG. 1.

FIG. 2 shows a cross sectional view of push-in wire connector 10 taken along plane x-x of FIG. 1. Push-in wire connector 10 comprises a housing 12, which for example may be made from an electrical insulating material such as a polymer plastic, with a chamber 12*a* therein. Located in the chamber 12*a* and held in position by housing 12 is an electrical conductor comprising a bus strip 13 that has a lower section 13*a* and an upper section 13*b* with an opening 13*d* for insertion of an electrical wire therein. Positioned proximate to the bus strip section 13*b* is a resilient electrical conductor 17 having a wire contact region comprising an edge 17*b* for scrapingly engaging an outer surface of an electrical wire. The resilient conductor 17 is positioned so as to extend over at least a portion of the opening 13*d* in the bus strip 13. Also located in chamber 12*a* is a wire displaceable sealant 20 waterproofing the resilient conductor 17 and bus strip 13 in the chamber 12*a* so that axial insertion of a wire into the axial passage flexes the resilient conductor 17 while forming a waterproof electrical connection to the resilient conductor 17 and the bus strip while the bus strip 13 and the conductor 17 remain protected by the sealant 20.

As can be seen in FIG. 2 the wire displaceable sealant is located in chamber 12*a* and inlet 24 and covers the top surface 13*c* of bus strip 13 as well as the end of electrical conductor to waterproof the bus strip 13 and the electrical conductor 17. The wire displaceable sealant 20 located in the chamber 12*a* waterproofs the resilient conductor 17 in the chamber 12*a* since the sealant surrounds normally exposed portions of the resilient conductor 17. It has also been found that the waterproof sealant surrounding the resilient conductor 17 can be maintained in contact with conductor during movement of the resilient conductor as a wire is axially inserted into the axial passage 24 and into engagement with the resilient conductor. That is, the resilient conductor 17 can flex and move in the presence of the wire displaceable sealant 20 while extending the waterproof covering to an electrical connection between conductor 17 and a wire that is axially inserted into engagement with the conductor 17. It has been further found that although the resilient conductor 17 can generate limited compressive force on a wire in the resilient conductor one can still form a low resilient electrical connection between the wire and the resilient conductor 17 in the presence of an electrically insulating sealant. While the ability to form a low resistance electrical connection in the presence of the electrically insulating sealant with a push-in wire connector was unexpected it is believed it may in part be due to a wiping or scraping action between the resilient conductor and the wire as the wire is axially inserted into the push-in wire connector. In any event, it has been found that the need to encapsulate the entire push-in wire connector to waterproof the wire connection therein can be avoided with the invention shown herein.

Electrical conductor 17 comprises a resiliently displaceable member, which is cantilevered mounted, such as a leaf spring or the like which may be held in face to face contact with member 13*b* through fastening members such as spot welds or mechanical fasteners. As can be seen in FIG. 2 the wire displaceable sealant 20 encompasses or protects the conducting components of bus strip 13 and the angled end 17*b* of conductor 17 from moisture. While 24 socket has been shown and described the socket 34 is identical and is not described herein.

In the example of FIG. 1 behind each socket of the push-in wire connector 10 is a resilient member that is an electrical conductor and a common bus strip that extends from one socket to the other socket so that two or more wires can be electrically joined in the presence of a wire displaceable sealant by axially inserting a bared end of an electrical wire into each of the wire sockets 24 and 34 in housing 12.

Figure 3:
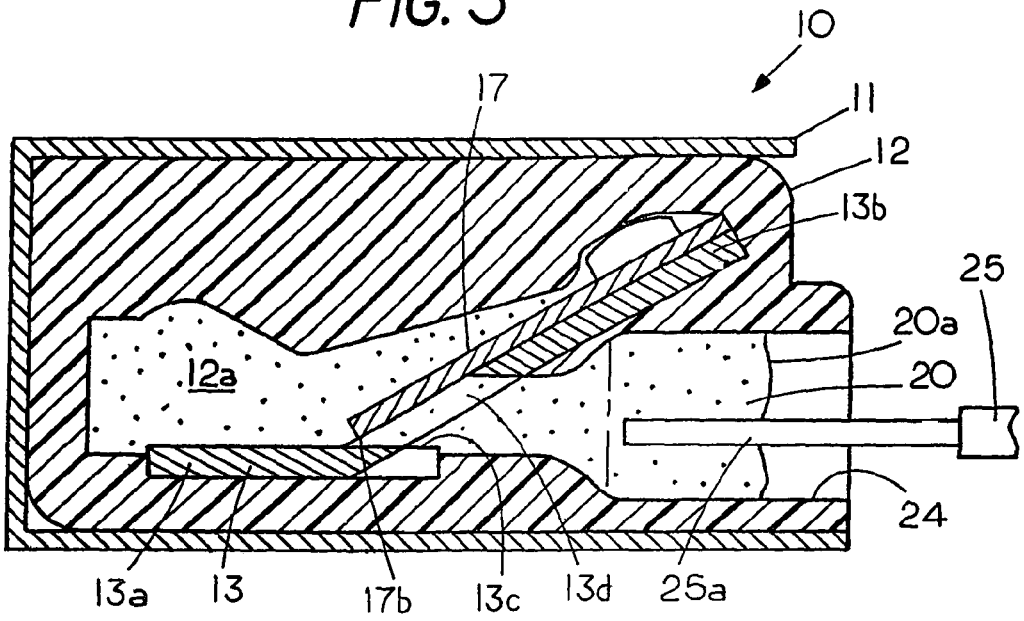
FIG. 3 shows a cross sectional view of the push-in wire connector of FIG. 2 with the bared end of an electrical wire penetrating an interface of a sealant located in the push-in wire connector.

FIG. 3 to FIG. 6 illustrate the single step of forming an electrical connection in a push-in wire connector in the presence of a waterproof sealant that is also an electrical insulator. FIG. 3 shows the push-in wire connector 10 having an electrical wire 25 with a bared or insulation free end 25*a* penetrating the sealant interface 20*a*. In this phase of the step of forming of the waterproof electrical connection the bared end 25*a* of wire 25 is axially inserted into socket 24 and into the sealant 20 in the push-in wire connector 10. The sealant 20 is wire displaceable, that is the resistant to the axial insertion of the wire 25 therein can be overcome by the axial stiffness of the wire 25 and in addition the resistance to penetration of sealant 20 by wire 25 is insufficient to cause bending of the wire 25 as the wire end 25*a* is inserted into the wire displaceable sealant 20.

The sealant 20, which is a waterproof sealant, is located in the push-in wire connector is characterized as a wire displaceable sealant. A wire displaceable sealant is sufficiently viscous so as to be normally retainable within the push-in wire connector during handling and storage of the push-in wire connector, yet yieldable and self healing to form a waterproof covering over a wire inserted therein. An examples of a type of sealant that may be used is a gel sealant although still other types of sealants such as silicone sealants that may be used.

Gel sealants are commercially available in liquid form i.e. an uncured state and are often used for vibration damping. The gel sealant, when in the liquid or uncured state, is poured or placed into the chamber 12*a* in the push-in connector 10 containing a moveable part such as the resilient conductor 17. Since the sealant is in liquid form with low viscosity the sealant 20 flows around any movable parts, i.e. the resilient conductor 17 in the push-in wire connector. Once in position the sealant sets or cures to form a waterproof sealant that has sufficient cohesiveness so as to retain itself within the housing 12 in a ready to use condition. Once cured the gel sealant is capable of yielding in response to conductor movement and axial insertion of a wire into engagement with the conductor as well as self healing to form a waterproof covering over an electrical connection between an electrical wire inserted between the resilient conductor and the bus strip in the push-in wire connector.

If one wants to ensure that no pockets of air are retained in the chamber in the push-in wire connector the air can be removed from the chamber 12*a* before injecting the sealant in the chamber 12*a*. As an alternate method, an opening can be placed in the top portion of the housing 12 so that air is forced out as the sealant is injected therein. A further option is to have the ports extending upward as the sealant is directed into the chamber in the push-in wire connector so air can be forced out of the chamber as sealant is introduced therein. Sealants that can be placed in push-in wire connector, for example in assembled push-in wire connectors, can be either in liquid form or in viscous form. An example of a sealant in liquid form is a curable gel that is commercially available and generally comprises two parts that may either be mixed in the wire connector chamber or before placing the curable gel in the chamber of the push-in wire connector. The use of a curable gel in liquid form allows the gel, while still in the liquid state, to flow around and encapsulate or protect the wire contacting surfaces components in the chamber including the moving part or parts of the push-in wire connector.

Another method for introducing the sealant into an assembled or partially assembled push-in wire connector is to force or inject a viscous sealant into one of the ports until the sealant begins to appear in the other ports. It has been found that as the sealant 20 flows from one port to another port through the chamber the sealant flows around the wire connecting surfaces 17*b* and 13*c* in the push-in wire connector. Also, in flowing from port to port air can be forced from the chamber 12*a* to provide a waterproof covering around the wire connecting surfaces 17*b* and 13*c* that contact a wire inserted therein. The method of port injection can also be used if the push-in wire connector contains multiple ports, in such a case the sealant may be injected or forced into one or more of the ports.

While the introduction of sealant into the push-in wire connector may be stopped based on a visual indication, such as the sealant becoming visible in another port, it also may be stopped based on a known volume of sealant injected into the push-in wire connector. Also, the amount of sealant injected into the push-in wire connector may vary depending on the wiring application. For example, in some applications it may be desired that sealant not extend outside the ports of the push-in wire connector and in other applications one may want the sealant to extend outside the ports of the push-in wire connectors and onto the housing.

Figure 4:
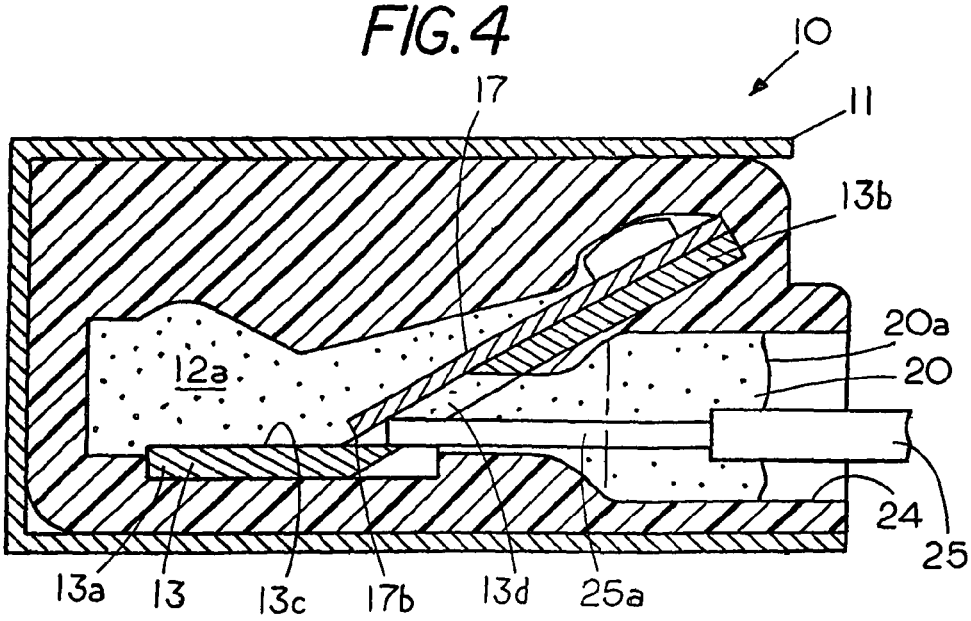
FIG. 4 shows a cross sectional view of the push-in wire connector of FIG. 2 with the bared end of an electrical wire contacting the bus strip and an electrical conductor.

FIG. 4 shows the axial progression of the wire end 25*a* as it contacts the underside of the electrical conductor 17 and the top surface 13*c* of the bus strip 13. At this point the resilient conductor 17 begins to offer resistance to axial insertion of the bared end 25*a* of wire 25 therein. However, the combined axial resistance offered by the conductor and the sealant to the wire end 25*a* must be insufficient so as not to bend the wire and prevent insertion of the wire end 25*a* into electrical contact with the conductor 17 and the bus strip 13.

Figure 5:
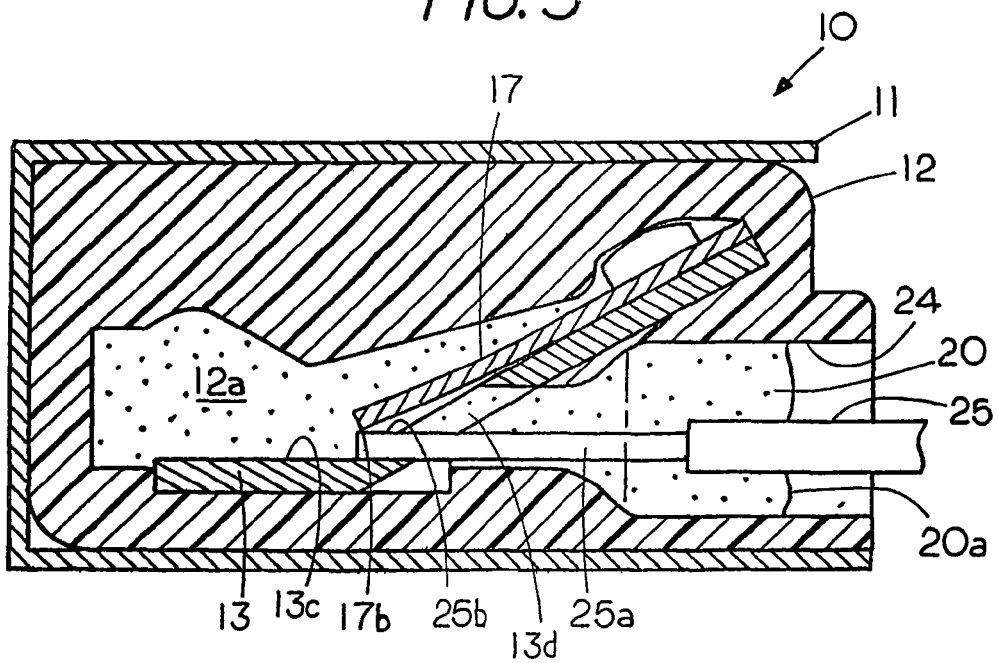
FIG. 5 shows a cross sectional view of the push-in wire connector of FIG. 2 with the bared end of an electrical wire located between an edge of the electrical conductor and a bus strip.
Figure 6:
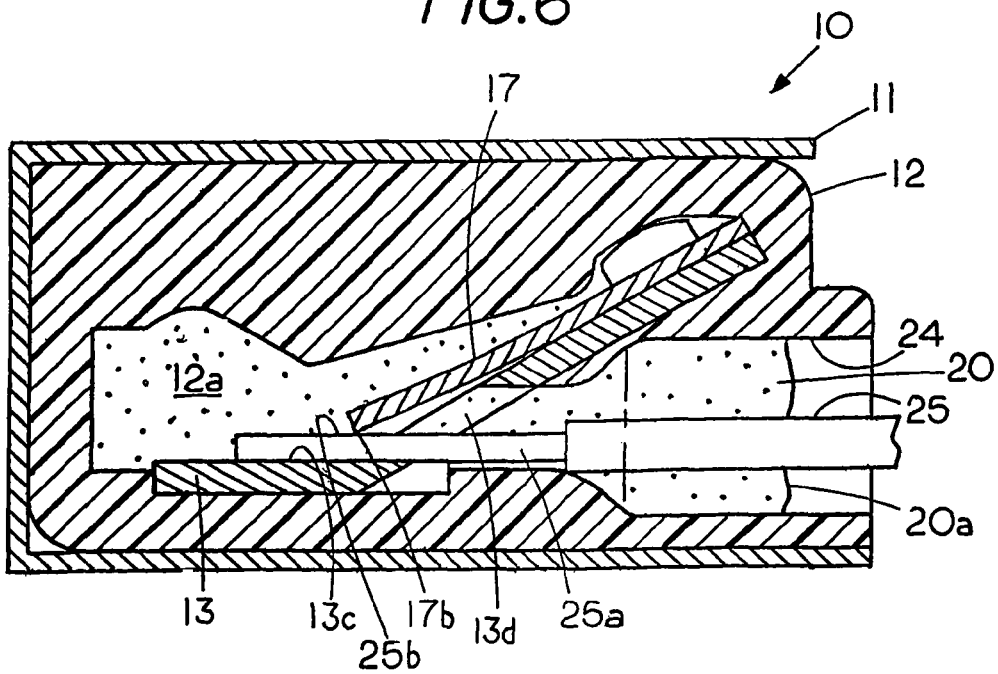
FIG. 6 shows a cross sectional view of the push-in wire connector of FIG. 2 with the bared end of an electrical wire in electrical contact with both the bus strip and an edge of an electrical conductor.

FIG. 5 shows the next phase in the insertion process as the bared end 25*a* is axially inserted into electrical contact with conductor 17, namely, the flexing or resilient displacement of the conductor 17 causing the edge 17*b* of conductor to engage the surface of conductor 25 while in the presence of sealant 20. In the embodiment shown the edge 17*b* comprises junctions of a right angle of two faces of conductor 17. As the edge 17*b* is held against the outer surface of the wire 25*a* and the wire end 25*a* is axially inserted the edge 17*b* scrapes away the electrically insulating sealant that is on the bared end of the wire to bring the edge 17*b* into electrical contact with the bared end of the wire 25*a*. In addition the surface 17*b* is also wiped or scoured by the axial insertion of the wire end 25*a* since the wire 25*a* is held against the bus strip 13 by the resilience of conductor 17. Thus the method of forming a waterproof electrical connection includes the single continuous step of axially inserting an end of a bared wire 25*a* into an inlet passage 24 of a push-in wire connector 10 containing an electrical conductor 17 having a resiliently restrained edge 17*b* which is encapsulated in the wire displaceable sealant 20 followed by axially forcing the end 25*a* of the bared wire past the resiliently restrained edge 17*b* which is encapsulated or protected in the wire displaceable sealant 20, to simultaneously wipe the wire displaceable sealant 20 away from a junction between an outer surface 25*b* of the bared wire 25*a* and the resiliently restrained edge 17*b* to thereby form a waterproof electrical connection between the resiliently restrained edge 17*b* and the bared wire 25*a* in the presence of the wire displaceable sealant 20.

While the wire displaceable sealant may be a gel sealant or silicone sealant other sealants that can retain themselves within the connector and provide a waterproof connection in the presence of the sealant may be used as a waterproofing sealant.

Referring to FIGS. 2-6 in the one step process of forming a waterproof electrical connection an electrical wire 25 having a bared end 25*a* is axially inserted into the socket 24 until the wire end 25*a* penetrates the opening 13*c* in bus strip 13. As the wire end is forced through opening 13*c* the engagement with the conductor 17 forces the wire end 25*a* into pressure contact with the bus strip 13 to make electrical contact between the wire 25*a* and the bus strip 13. The positioning of the conductor 17 at an angle prevents accidental withdrawal of the wire as the edge 17*b* can bite into the electrical wire and also functions to wipe sealant off a portion of the wire to better enable formation of electrical contact therewith. In addition, by having the conductor resilient or maintaining a force on the conductor one also maintains contact pressure between the wire and the conductor to ensure electrically continuity therebetween.

We claim:

1. A waterproof push-in wire connector comprising:

a housing having a chamber therein;

an electrical conductor located in said chamber, said electrical conductor comprising a bus strip having a lower section, an upper section and an axial passage therein for insertion of a wire;

a resilient conductor located in the chamber with the resilient conductor normally extending at least partially across an axial passage in the housing; and a wire displaceable sealant located in the chamber with the wire displaceable sealant waterproofing the electrical conductor and the resilient conductor in the chamber so that axial insertion of a wire into the axial passage flexes the resilient conductor into an electrical connection in the presence of the wire displaceable sealant to form a waterproof covering over an electrical connection between the wire and the electrical conductor and between the wire and the resilient conductor.

2. The waterproof push-in wire connector of claim 1 wherein the wire displaceable sealant is viscous and an electrical insulator.

3. The waterproof push-in wire connector of claim 1 wherein the wire displaceable sealant comprises silicone.

4. The waterproof push-in wire connector of claim 1 wherein the resilient conductor comprises a cantilevered mounted conductor having a face coextensive with a portion the upper section of the bus strip.

5. The waterproof push-in wire connector of claim 1 wherein the sole means of forming electrical contact with the bus strip is through pressure contact between the bus strip and the resilient conductor in the presence of the wire displaceable sealant.

6. The waterproof push-in wire connector of claim 1 wherein the axial passage in the bus strip laterally confines the wire therein.

7. The waterproof push-in wire connector of claim 1 wherein the resilient conductor comprises a resiliently restrained edge in engagement with an outer surface of the wire.

* * * * *